US008438786B2

(12) United States Patent
Jacobs et al.

(10) Patent No.: US 8,438,786 B2
(45) Date of Patent: May 14, 2013

(54) FLEXIBLE VENUE SYSTEM

(75) Inventors: Frederick D. Jacobs, Holland, MI (US); Michiel P. van de Ven, West Olive, MI (US); Dennis V. Rupar, Spring Lake, MI (US); Jonathan D. Emery, Coopersville, MI (US); Joshua A. Bordewyk, Fruitport, MI (US); Ivan J. Furbish, Sanford, ME (US)

(73) Assignee: Irwin Seating Company, Grand Rapids, MI (US)

( * ) Notice: Subject to any disclaimer, the term of this patent is extended or adjusted under 35 U.S.C. 154(b) by 350 days.

(21) Appl. No.: 12/841,476

(22) Filed: Jul. 22, 2010

(65) Prior Publication Data

US 2011/0016798 A1 Jan. 27, 2011

Related U.S. Application Data

(60) Provisional application No. 61/227,965, filed on Jul. 23, 2009.

(51) Int. Cl.
*E04H 3/12* (2006.01)

(52) U.S. Cl.
USPC ..... 52/9; 52/741.1

(58) Field of Classification Search ..... 52/6–10, 52/741.1, 741.2, 745.05
See application file for complete search history.

(56) References Cited

U.S. PATENT DOCUMENTS 4,063,392 A * 12/1977 Van Ryn et al. ..... 52/9
4,155,202 A * 5/1979 Hartman ..... 52/9
4,179,090 A 12/1979 Williams et al.
4,189,876 A * 2/1980 Crossman et al. ..... 52/9
4,557,080 A * 12/1985 Walworth et al. ..... 52/9
4,702,043 A * 10/1987 Suzuki ..... 52/9
5,328,238 A * 7/1994 Yamazaki ..... 297/332
5,685,608 A * 11/1997 Yamazaki ..... 297/335
5,784,835 A * 7/1998 McArthur, Jr. ..... 52/9
5,819,475 A * 10/1998 Momose ..... 52/10
6,041,554 A * 3/2000 McArthur, Jr. ..... 52/9
6,055,780 A * 5/2000 Yamazaki ..... 52/9
6,076,306 A 6/2000 Victor et al.
RE37,043 E * 2/2001 Yamazaki ..... 297/332
6,212,828 B1 * 4/2001 McArthur, Jr. ..... 52/9
6,244,657 B1 * 6/2001 Momose ..... 297/217.7
7,617,635 B2 * 11/2009 Jacobs et al. ..... 52/8
2003/0009950 A1 * 1/2003 Hallberg ..... 52/8
2008/0190038 A1 8/2008 Jacobs et al.

* cited by examiner

*Primary Examiner* — Basil Katcheves
*Assistant Examiner* — Theodore Adamos
(74) *Attorney, Agent, or Firm* — Price Heneveld LLP

(57) ABSTRACT

A flexible venue system includes a system that can be configured in multiple ways depending on the type of event being hosted. This system can be applied in whole or in part to telescopic seating platforms or similar structures which may include multiple usable tiers, movable between an extended configuration and a retracted configuration, and the potential for at least one partially retracted configuration. The system may include any or both of a program support system integrated into or assembled to the system prior to retraction; and vertically adjustable seating configurations for use with the platform systems. The present invention is intended to aid in venue changeover and reduce overall cost, instructions and labor required to do so.

8 Claims, 10 Drawing Sheets

FLEXIBLE VENUE SYSTEM

This application claims benefit under 35 U.S.C. §119(e) of provisional application Ser. No. 61/227,965, filed Jul. 23, 2009, entitle FLEXIBLE VENUE SYSTEM, the entire contents of which are incorporated herein in their entirety.

BACKGROUND

The present invention relates to a flexible venue system for crowd management with integrated components facilitating flexible configuration, reconfiguration including partial expansions, and storage. While telescopic seating platform systems are clearly candidates to receive the inventions noted herein, it is contemplated that a scope of the present concepts is not limited to only the illustrated application, nor is it limited to a specific type of seating.

Telescopic platforms are oftentimes used to provide portable and configurable seating options for gymnasiums, theaters, arenas, stadiums, and any venue that provides public seating. A majority of the seating for any of these venues is considered fixed seating and cannot be readily reconfigured for various events. The area closest to the surface where the action is taking place is typically populated with telescopic platforms. The proximity of the telescopic seating platform with respect to the action justifies the need for seating that offers a higher degree of comfort and multiple configurations based on the type of event. Typical seating options for telescopic platforms include folding chairs, fold forward chairs and nose mount chairs cantilevered to provide foot space.

There is a desire in entertainment venues for a seating system that is flexible, affordable and can be changed rapidly from one event to another. Attempts to accomplish this often include multiple telescopic platforms where size, tier spacing (rise) and platform shape are intended to provide maximize seating space utilization through reconfiguring sightlines, and where platform configurations are based on a size of the action field based on the event.

In some specific events, the organizer may wish to use only a portion of a telescopic platform. In this type of configuration, the upper tiers are extended for use and the lower tiers remain in a retracted position. In this configuration, the top rows must be supported in a manner that is superior to the cantilevered configuration that is present when the platform is retracted. Also the front row of seating requires a front, intermediate horizontal railing and gates at aisle locations for safety purposes. Further, should full sections of seating be removed or adjacent sections partially retracted, end rails must be utilized to protect the safety of the patron per applicable building codes. Also, it is desirable to provide a way to remove the section and place it into storage.

A program support is the common name for the device utilized to provide the structural member that can be used to stabilize the first usable row of decking on a partially retracted telescopic seating system. Jacobs, Published Application No. US 2008/0190038A1 illustrates one such embodiment of an adjustable program support (20), and also see Williams, U.S. Pat. No. 4,179,090 which defines an adjustable vertical pole with supporting structure used to support the decking of a scaffolding system. These poles support a front edge of the lowermost, otherwise cantilevered, occupied row of the seating system. However, both of these devices require either the removal of seats on the row or rows below the lowest being utilized, and/or action to install after retraction, which can be difficult to perform due to the height at which the first usable row may be. Further, these solutions require storage of extra components that may be either misplaced or require multiple variations to meet the various retraction configurations.

When platform sections must be moved or transported to another location, often lift trucks or portable dollies are used. After retraction, lift beams must be added to the system to provide structural members capable of interfacing with the many different individual structures that form the supports for each individual row. This involves working low to the ground and aligning and affixing heavy members in precise alignment to the appropriate points on the system chassis to transport the unit to storage, and then removal after reinstating the section in the venue.

Another challenge is found in systems that have multiple rise heights required for the last row of seating due to differences in configurations exist. Typically a venue is forced to utilize folding chairs and/or floor mounted chairs on that particular row. This can present a number of issues, the first being that a folding chair is not universally considered a premium, comfortable seating option. Next, a floor mounted chair can present issues when changing between a pair of different platform sets, should a dual-platform system be used such as when changing from a more gradually sloped basketball-type configuration to a greater slope hockey configuration. To change over, either a second set of chairs is required, or the entire row must be removed and transferred, to maintain a constant seat-to-floor relationship. Further, if there is a need to store these chairs, by the bulky nature typical of assembled spectator seating, they are not conducive to storing in a small footprint and drive up storage space requirements within the venue.

To summarize, typical known solutions to these dilemmas have required removal of components and installation of additional parts that are usually stored in a remote location when not in use. Further, existing systems require action in non-ideal conditions, such as after movement of the system has occurred (i.e., after a telescopic platform is partially or fully retracted). The addition of components that require the use of separate fasteners, loose parts and assigned use locations also present the opportunity to lose them and/or mix-up the organization of the parts, creating confusion at the time of the venue changeover. Recurring labor-intensive operations tend to cost more in the long run to a facility, and historical constructions can lead to additional safety hazards for the maintenance personnel.

SUMMARY OF INVENTION

In one aspect of the present invention, a flexible venue system comprises a telescopic platform system including multiple usable tiers movable to an extended configuration, a retracted configuration, and at least one partially retracted configuration. The system further includes a plurality of seats on the tiers with backs and seat components movable to a use position when the platform system is extended and movable to a storage position for dense storage when the tiers of the platform system are retracted. A seating support system supports the seats and includes at least one integral program support that engages above-located structure on the platform system when the seats are in the storage position and when the telescopic platform system is in the partially retracted configuration for supporting and thus managing a load of a first usable one of the tiers.

In another aspect of the present invention, a flexible venue system includes at least one row of seats with backs and seat components movable between a collapsed position and a usable position, and a seating support system supporting the row of seats. The seating support system includes at least one adjustment mechanism adjustably supporting the row of seats for height adjustment between at least a raised position and a lowered position.

The present invention provides simple, inexpensive and integrated means to achieve a variety of program configurations using novel approaches, generally relating to spectator seating, structural/transportation members and crowd control devices positioned on and around a telescopic platform system.

Related methods are also contemplated to be novel, useful, unobvious, and to provide surprising and unexpected results to persons skilled in this art.

These and other aspects, objects, and features of the present invention will be understood and appreciated by those skilled in the art upon studying the following specifications, claims, and appended drawings.

DESCRIPTION OF FIGURES

FIGS. 3A-4A are enlarged side views of FIGS. 3-4, respectively, but with the back and seat cushion removed for clarity.

FIGS. 7A-8A are enlarged side views of FIGS. 7-8, but with the four-bar-linkage support attached to a structural horizontal nose beam, but with the back and seat cushion removed for clarity.

DETAILED DESCRIPTION OF THE CURRENT EMBODIMENT

The present arrangement includes features solving many of the operational and tactical concerns mentioned above for a flexible venue system. While telescopic seating platform systems are the most obvious candidates to receive the innovative features noted herein, it should be readily recognizable that a scope of their applicability is not limited to the illustrated application, nor even to a specific type of seating. Further, it is contemplated that the innovative concepts can be used separately or in combination.

Figure 1:
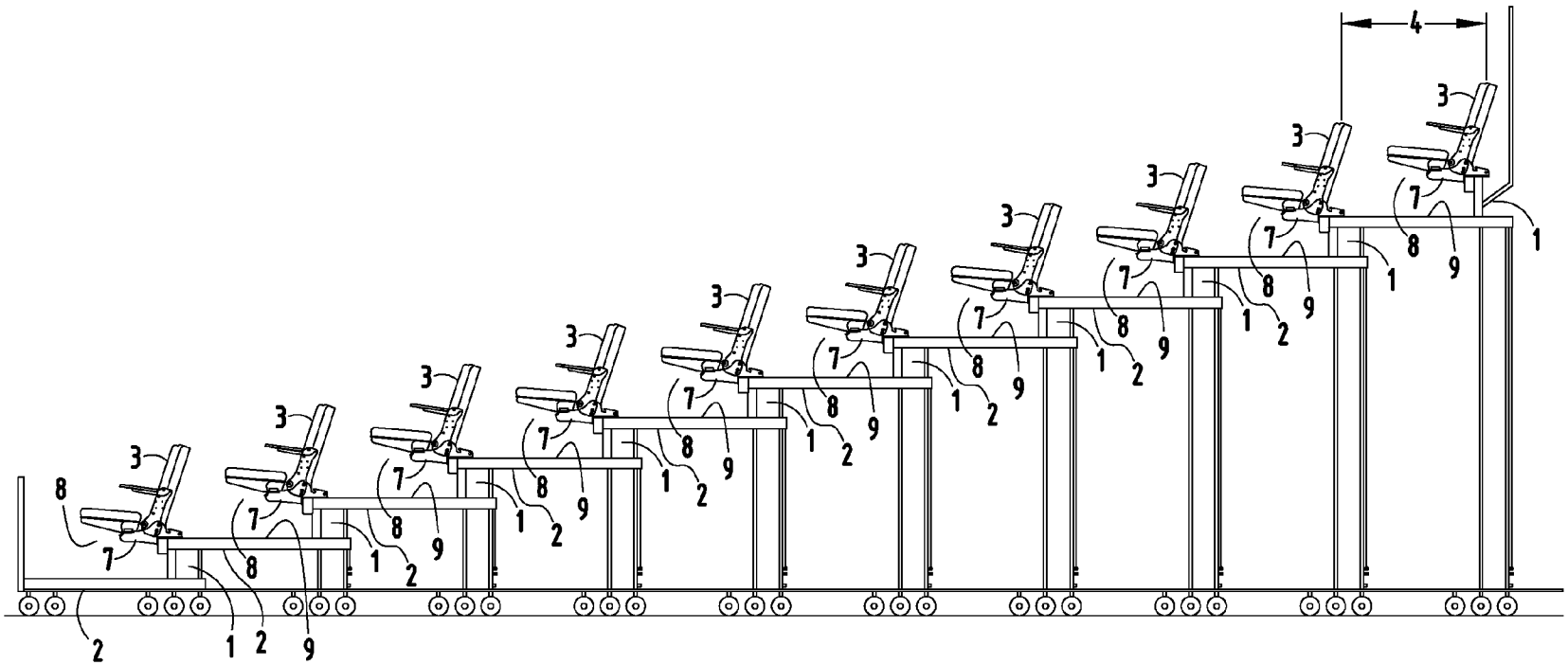
FIGS. 1-2 are side views of a flexible venue system with telescopic platforms having foldable seats, FIG. 1 showing the system expanded and FIG. 2 being partially retracted.
Figure 2:
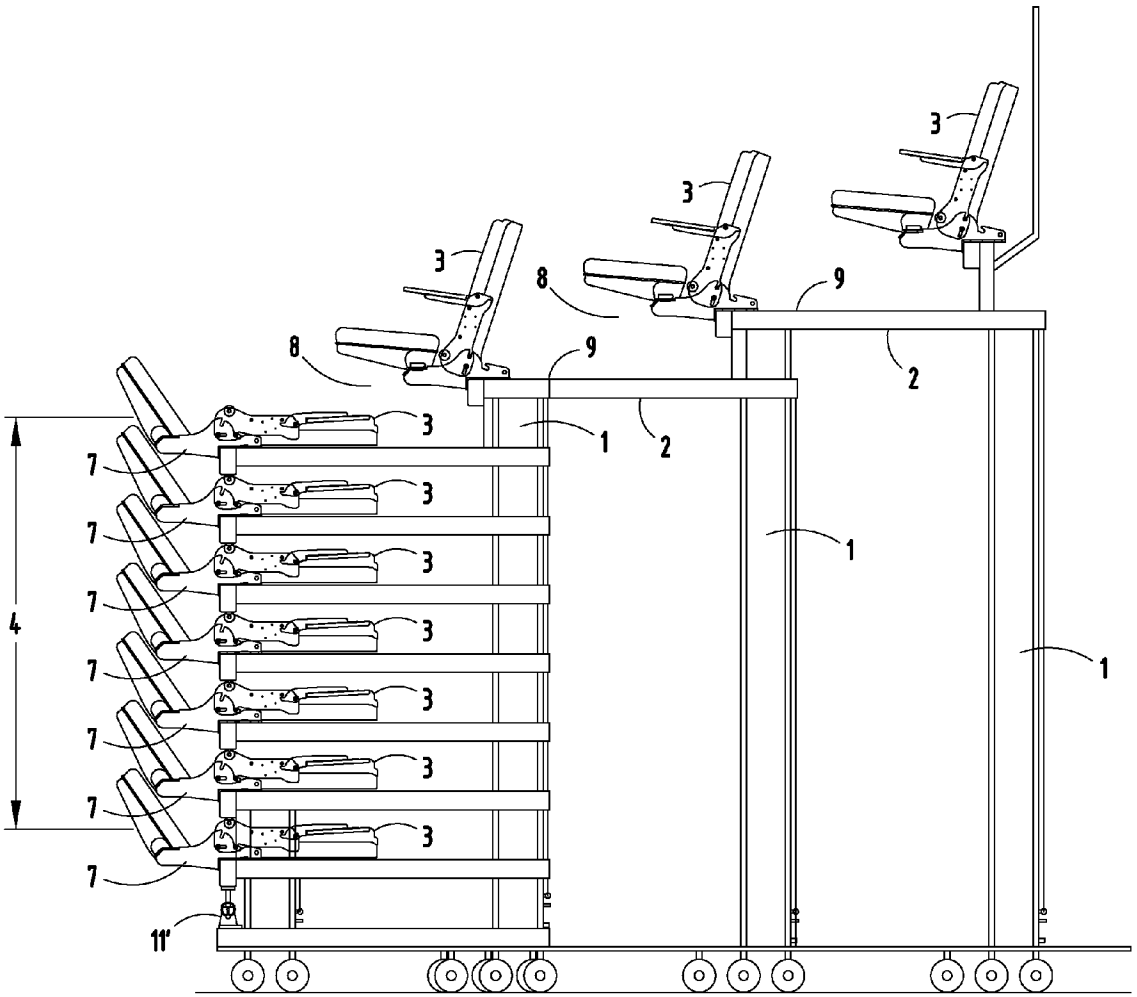

The present telescopic platform seating system (more broadly referred to as a "flexible venue system") includes wheeled substructure (1) (FIGS. 1-2) supporting platform tiers (2) with front mounted seats (3) for movement between extended/expanded (FIG. 1) and partially and/or fully retracted storage positions (FIG. 2 showing a partially retracted position). When expanded (FIG. 1), the seats (3) are spaced a distance (4) apart. The tiers (2) include a floor-forming component/tread (9) with underlying horizontal beams, and attachment/support brackets (7) (also called "seating standards") for supporting the seats (3) on a front of respective tiers (2) in a "nose mounted" position to create leg space (8).

Integrated Program Support

The telescopic platform seating system (FIGS. 1-2) (more broadly referred to as a "flexible venue system") includes an integrated program support (15) (FIG. 3A) integrated into the seating standard (11) for nose mounted chairs. Nose mounted chairs provide the maximum amount of comfort when used on a telescopic platform. The higher level of comfort is achieved through the use of upholstered seats and backs, but this invention is not limited to such applications. In this embodiment, a nose mounted chair is fitted with a specially designed standard so that the back can be positioned in an upright position when in use and alternatively can be laid flat onto the deck surface behind it to allow the telescopic platform tiers to be retracted.

Nose mounted seating standards are typically made from mild-grade sheet steel. The thickness of the sheet steel varies based on the amount of load and force associated with each component. The main fin structure (11*a*) of the nose mounted standard is fastened to the nose beam and to the deck. The main fin structure (11*a*) is often made from 0.25" thick 1010/1008 mild-grade steel. The folding back attachment support (11*b*) which can include an integrated arm rest support (11*d*) is typically made from 0.125" 1010/1008 mild-grade steel.

Figure 3:
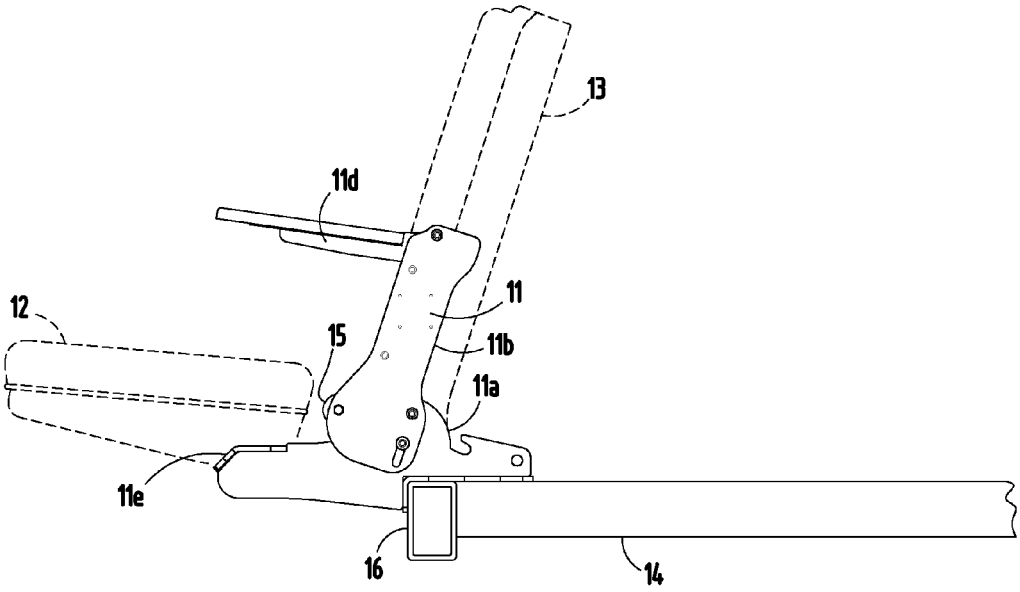
FIGS. 3-4 are side views of the telescopic platform seating system in FIG. 1-2 with an integrated program support, FIG. 3 showing a back in an upright position (with the seat cushion in a raised position), FIG. 4 showing a rearwardly-lowered back (with seat cushion in raised position).
Figure 3A:
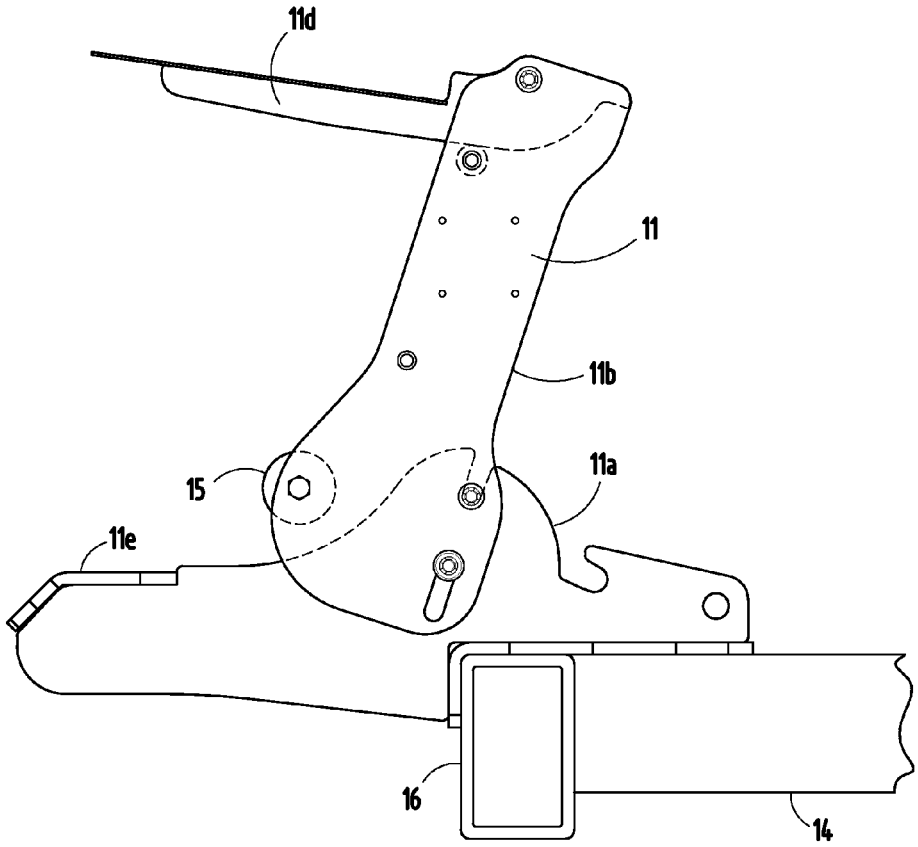

As illustrated, the folding back attachment structure contains the integrated program support (15). The mounting plate (11*c*) which is used to attach the nose mounted standard to the nose beam and deck support is generally made from 0.25" thick 1010/1008 mild-grade steel. The nose mounted seat back (13) in FIG. 3-3A is in an upright position and this configuration represents a configuration where the seat is ready to be occupied (i.e. once the seat component 12 is lowered), provided the floor-forming tread (9) below is present and supported.

Figure 4:
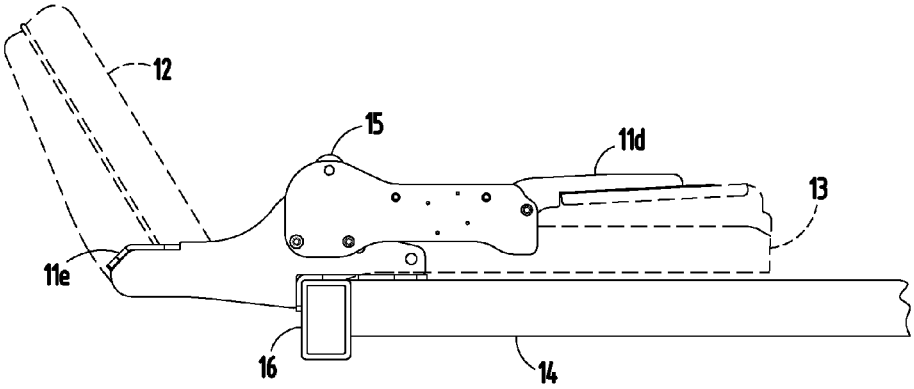
Figure 4A:
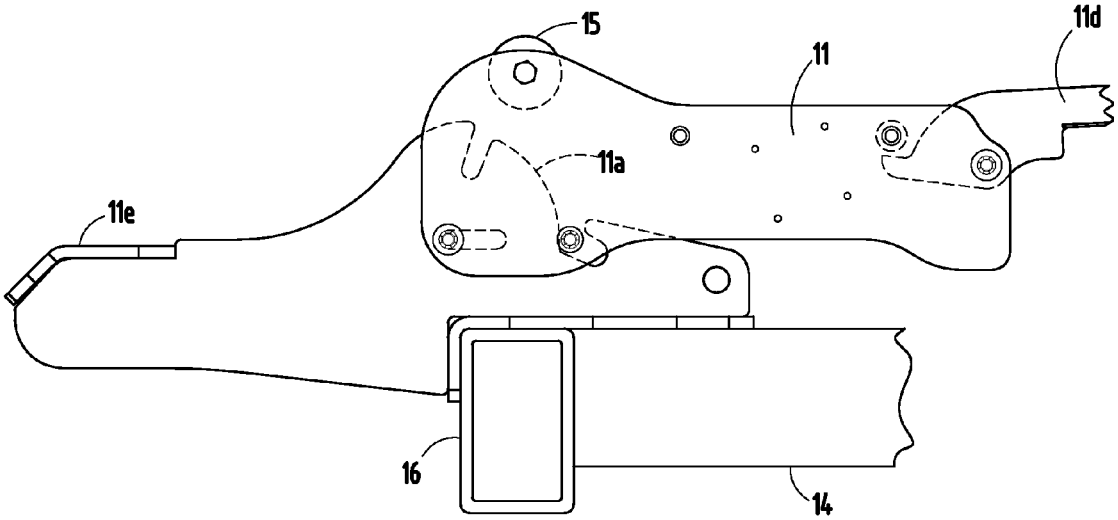
Figure 3B:
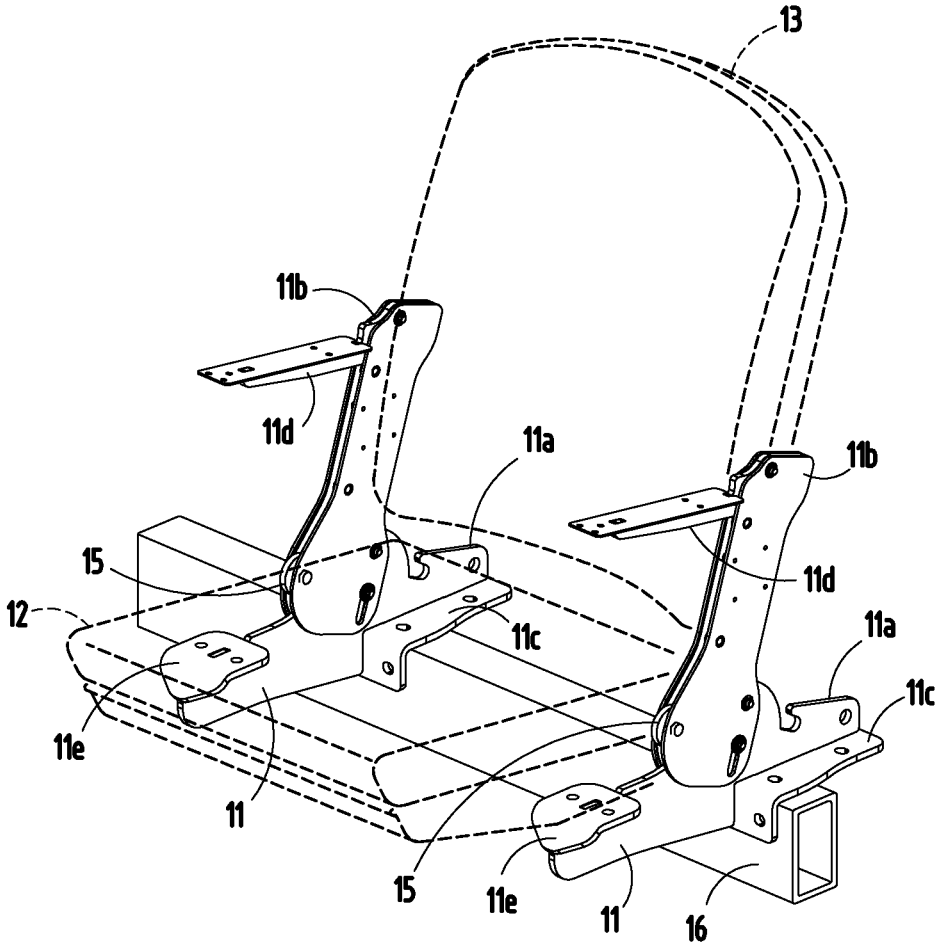
FIG. 3B is a perspective view of FIG. 3.
Figure 5:
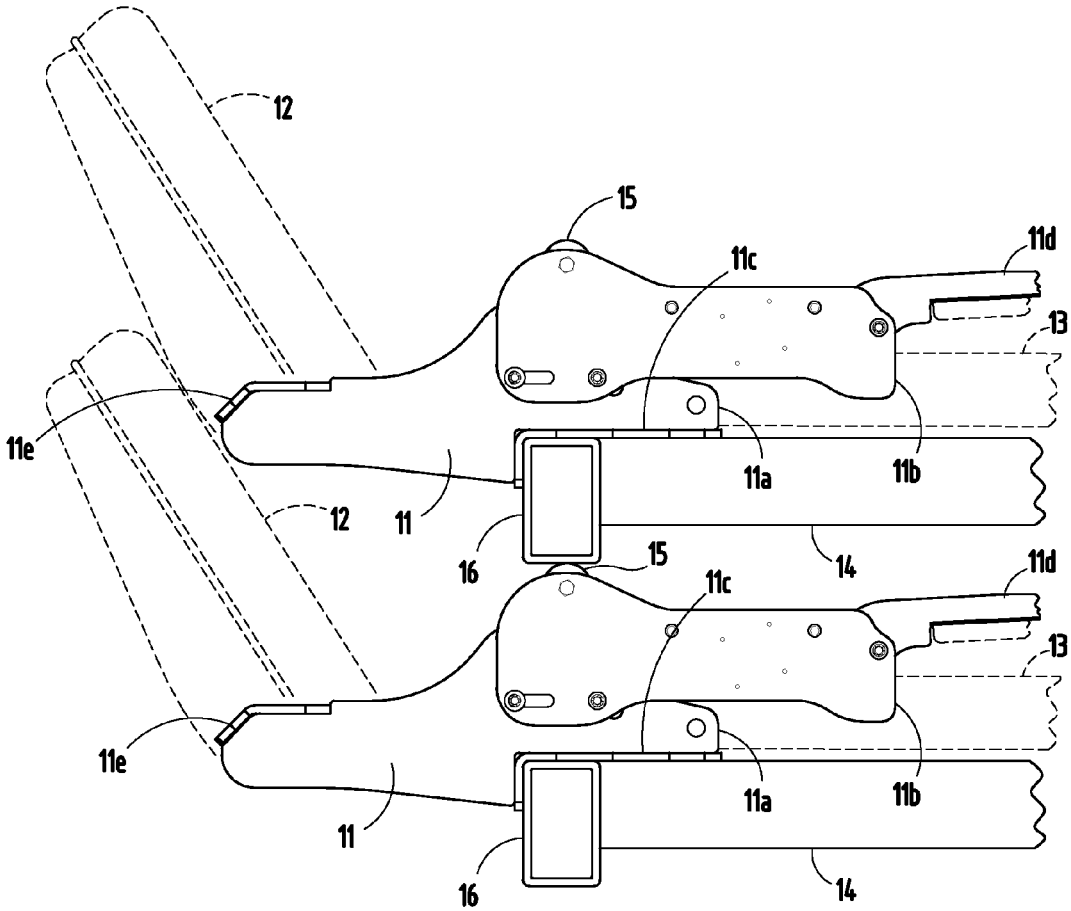
FIG. 5 is a side view similar to FIG. 4 but showing a lower tier and next-adjacent upper tier with the lower program support engaging a beam on the upper platform to thus support the upper platform.

In FIG. 4 (and FIG. 4A) the seat back (13) is laid flat on the associated deck (14) to which the seat (3) is mounted, and selected ones of the tier(s) can be retracted without the seat interfering with the tier located behind and above the subject tier. When the seat back for the nose mounted standard is lowered to lay on the deck of the tier and the system retracted, the integrated program support (15) automatically moves to an abutting position to support the nose beam (16) of the tier immediately behind and above the current tier (FIGS. 2 and 5). Features other than a tubular beam could be used to provide the load transfer between tiers depending on the deck construction. FIG. 2 also illustrates a jack stand (11') that supports a bottom front of the bottommost tier. The jack stand (11') could be replaced with a program support (15) is desired. The remaining tiers that are retracted are supported by engagement of the program support (15) with the nose beam (16) on the next higher tier.

The diameter of the roller of the integrated program support (15) can be modified to accommodate different tier-to-tier rise configurations. For more drastic rise variances, the shape of the integrated program support can be changed by increasing or decreasing the curvature of the area related to the integrated program support roller (15), changing a position of the hole supporting the axle of the program support roller (15), or changing top surface of the nose beam (16) that engages the roller (15). The change in any of these components or surfaces allows the placement of the integrated program support to be adjusted to accommodate various rises between tiers (see FIG. 5). Also, it is noted that a leading edge of the top surface of the nose beam (16) is radiused and provides a lead-in ramp as the program support roller (15) rolls onto the nose beam (16) during retraction of the seating system.

Figure 6:
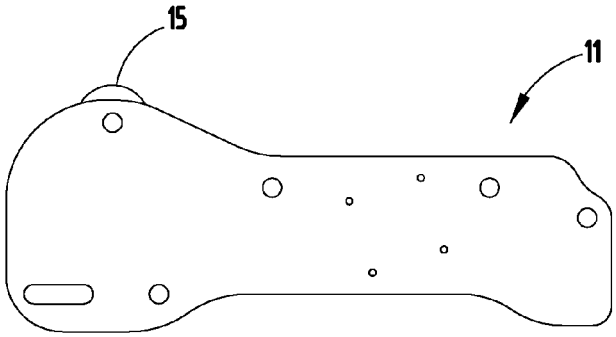
FIG. 6 is a side view of the integrated platform support component.

The embodiment described uses a roller as the integrated program support (15) (FIG. 5-6). In current applications, the roller is made from steel, but it should be noted that the roller can be made from any material suitable to handle the loads associated with a top usable tier. Also in some applications, it is contemplated that the roller can be replaced with a lubricious low-friction bearing block or skid plate. Since the integrated program support (15) is built into the nose mounted standard of every seat, the supported load is distributed to each and through each nose mounted standard to the tier below, and eventually down to the floor below.

FIG. 5 shows engagement of one version of an integrated program support (15) and the directly above nose beam (16). The pattern of placement associated with each integrated program support repeats for each of the tiers that are retracted. The load associated with the first usable tier is directed down vertically through each integrated nose support, nose beam standard, and nose beam for each of the tiers that are retracted. The embodiment presented here illustrates the integrated program support as ever-present metal roller, but to those skilled in the art, the integrated support could be constructed of any shape or material suitable to make contact with and support the load of the above tier when this tier is retracted. One such means would include the incorporation of a wave-like crest on feature 11*a* in FIG. 5. Also, serviceable components to accommodate friction and wear can be incorporated.

An objective of the present embodiment is to provide program support to the first usable tier of a partially retracted telescopic platform, in a convenient fashion that can be deployed prior to retraction of the system. It also does not need to require separate components which require storage when not in use.

The present embodiment provides the necessary support and does it by integrating into common components already present on a telescopic seating platform. A simplicity of the design presented here is usable across multiple seating types and tiered platforms. It is envisioned that the present integrated components can be manufactured, assembled, and used with minimal addition of material and cost. The present components allow the utilization of materials that are light weight and low cost, and integrated into the chair system without detracting from chair aesthetics.

The present system can be deployed/assembled prior to platform retraction as part of the basic construction, which is novel based on our knowledge of known systems. This eliminates having to work high in the air to attach components, and also removes the need for ladders and climbing on an unsupported platform. It also eliminates the problems associated with high loads on cantilevered seating/platform arrangements.

This system transfers load from deck-to-deck through the standards and program supports at each location down to the floor. Typical program supports are used on every second or third chair location, though more frequent or less frequent locations can be used depending on system requirements.

The present system includes integrated program supports, but it is contemplated that they could be configured as another additional piece attached to the chair either permanently or in another fashion, pivotably attached between a first and second positions, and possibly a third position for variable rise platforms, or they could be removably attached (i.e. separate pieces).

Note also that the present system could utilize an integral piece of the center standard (11*a*), such as a wave crest design on the top that supports the underside of the front edge of the platform deck above.

A wear bar or similar device could be attached to the underside of the deck in a position where it matably engages the program support 15, and that it could be made serviceable/replaceable (using fasteners or clip-in/hook-in attachment structure).

A lead-in ramp could be added to help lift the cantilevered deck above up/onto the support system as the roller program support 15 rolls onto the nose beam 16.

It is contemplated that an adjustable program support could be used, which would be used if a need arises to tweak the dimension of the support to match the rise being supported. The adjustable program support could use replacement parts having different dimensions to accommodate different rises between seats, or could have an adjustable member that can be moved between different positions to create the different dimensions.

Note, the illustrated rollers are interchangeable for diameter to support different rises within a range on the proposed variation above, and that the standard side plate (11*b*) could change if necessary for a larger deck spacing.

Additional/pivoting parts can be used on larger rise heights deck-to-deck, to minimize the amount of extra material allocated for this.

Another benefit is that these systems only need to be present in areas where the load is transferred to. The uppermost row of usable chairs in the most-retracted configuration through the top row does not need to have these features/accommodations, which saves cost and mass.

The present concept(s) is fully transferable to (useable on) fold-forward chairs, where the roller or ramp would be on the back side of the standard so when the chair rotates downward, the roller, ramp or other means is positioned upward.

A variation could be used with seat modules (sculpted buckets similar in function to the wood plank systems of old high school gymnasiums), wood plank bench and loose chair or straight riser (such as a choir would use) systems through an extra, deployable component (that either flips out, pulls up or is added onto the system).

Brief List of Benefits of Integrated Program Supports
- Integration
  - No additional storage needed for program supports
  - No program support adjustment needed between tiers
  - Defined placement location for program supports not needed
  - Minimal cost to implement
- Ease of Use
  - Fool proof
    - Integrated program support in place when chair or back is laid down on deck
    - No placement information needed
  - No additional labor needed to implement program support in select configurations
- Additional Benefits
  - Tier-to-Tier support when system retracted
  - Ability to partially retract/extend any number of tiers
  - Minimal material, cost, weight, additions to implement integrated program support
  - No maintenance required
  - Design can be modified to accommodate various riser heights Concept designed for nose mounted standards Nose mounted standards provide most comfortable chairs, but system adaptable to fold-forward, modules, bench or loose seating configurations.

Multiple Position Seating (Vertically Adjustable Seating)

Figure 7:
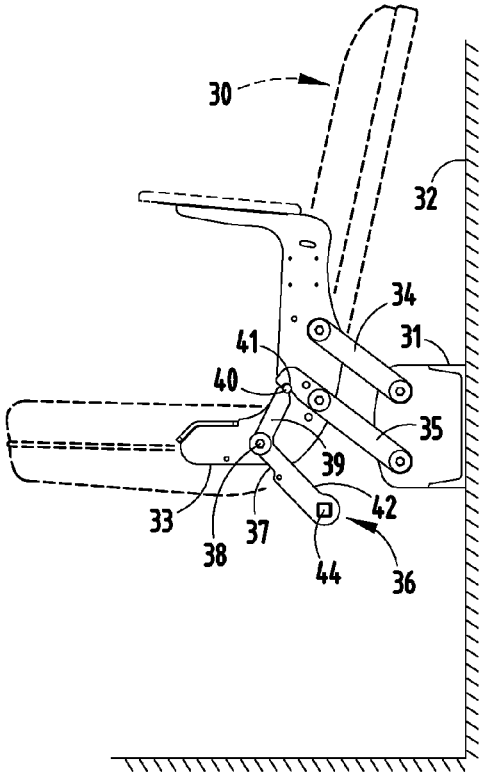
FIGS. 7-8 are side views of a modified seating system incorporating a four-bar-linkage support for providing vertical adjustability to the seating arrangement, the arrangement being mounted to a fixed wall or building structure, FIG. 7 showing the seats in a raised position and FIG. 8 showing the seat in a lowered position.
Figure 8:
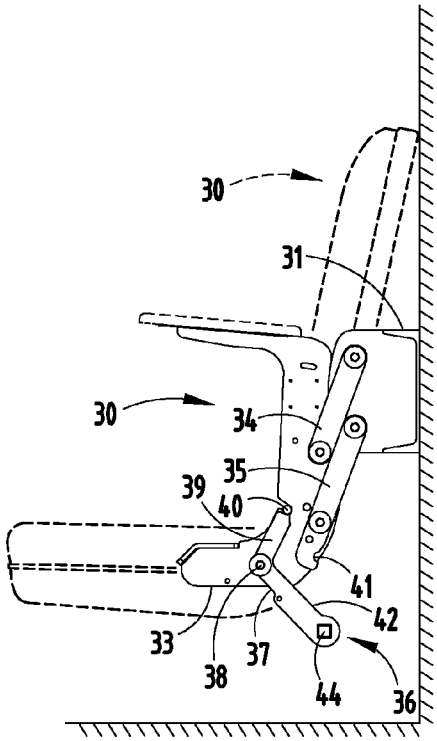
Figure 10:
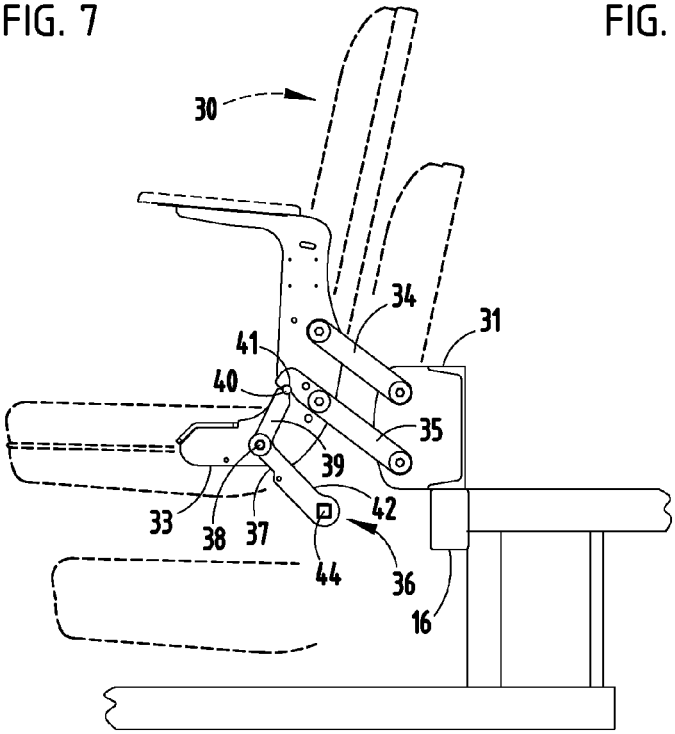
FIG. 10 is a side view of a seating system similar to FIG. 7 but mounted to a nose beam of a platform seating system like FIG. 3.
Figure 7A:
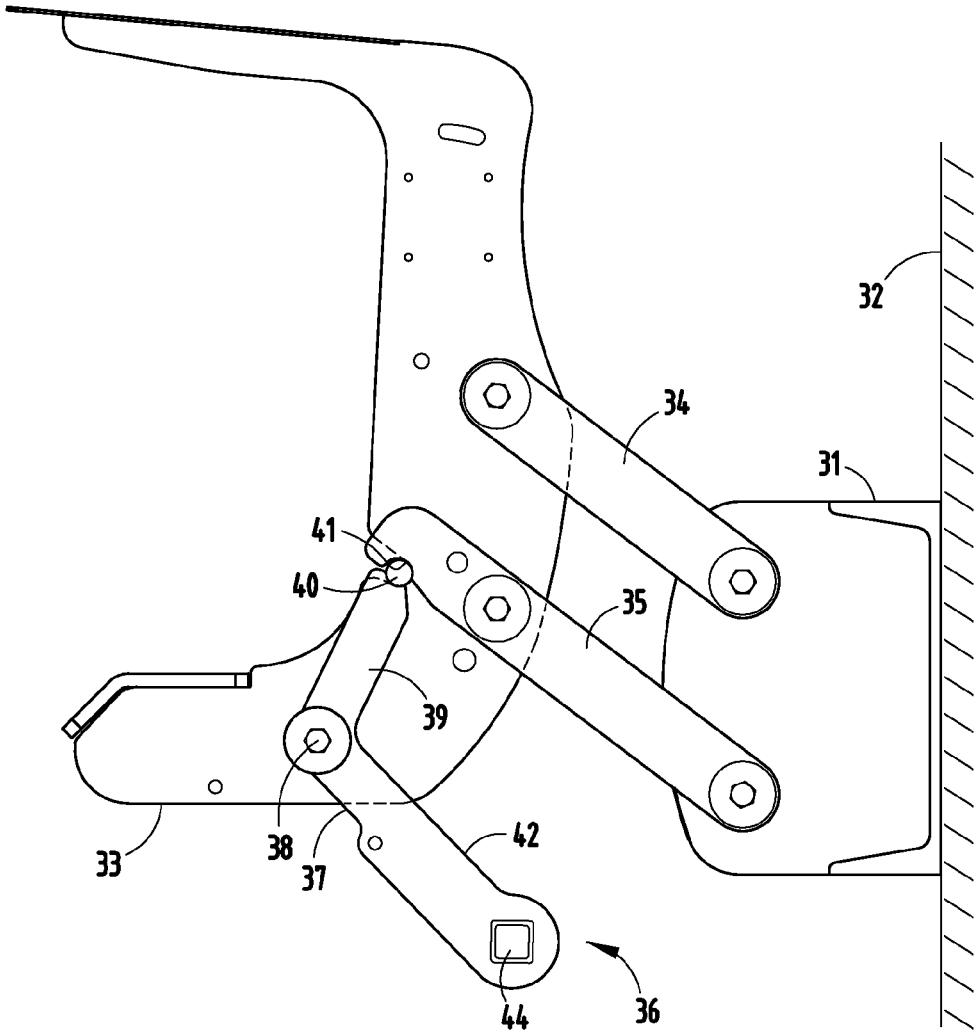
Figure 8A:
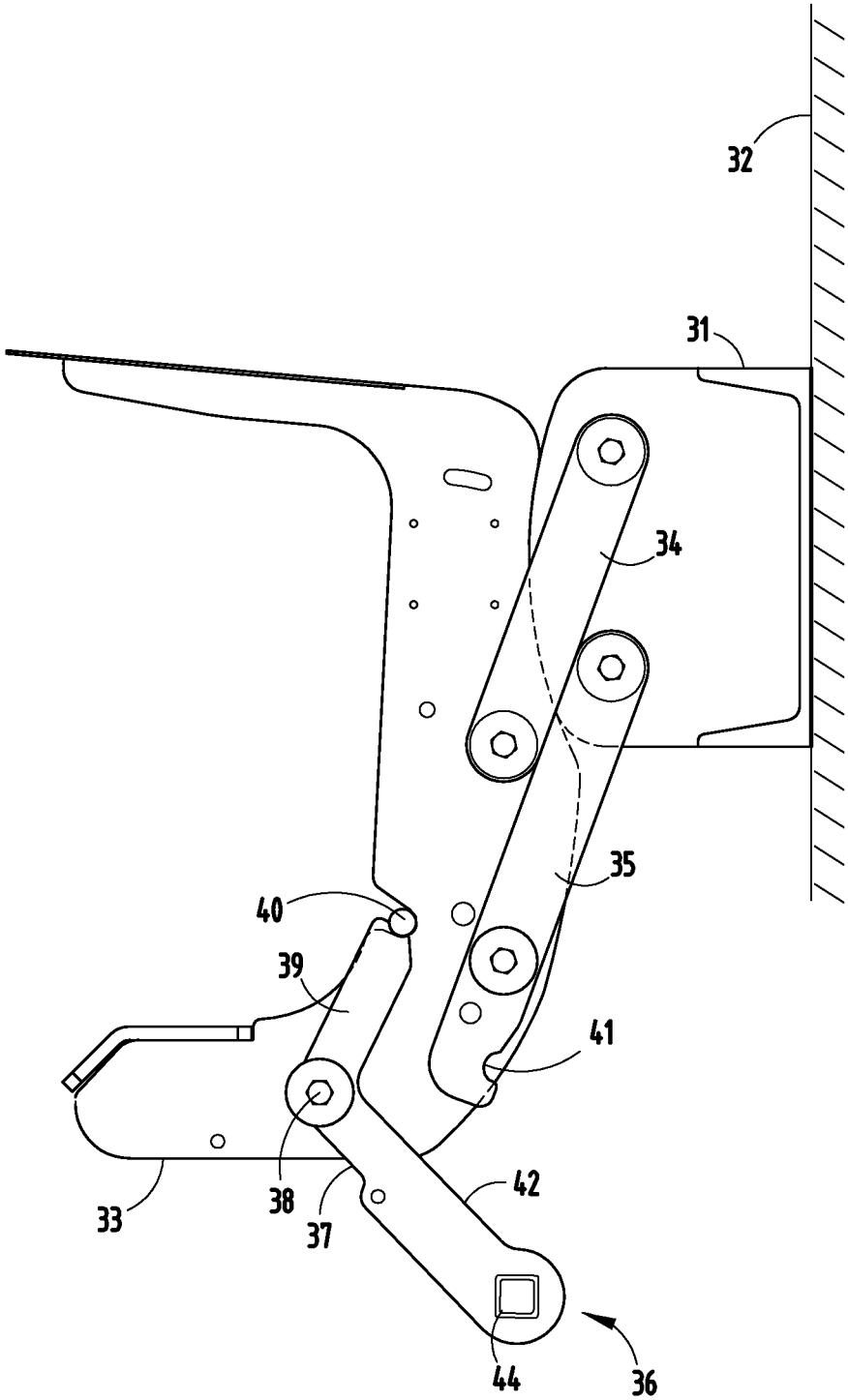
Figure 9:
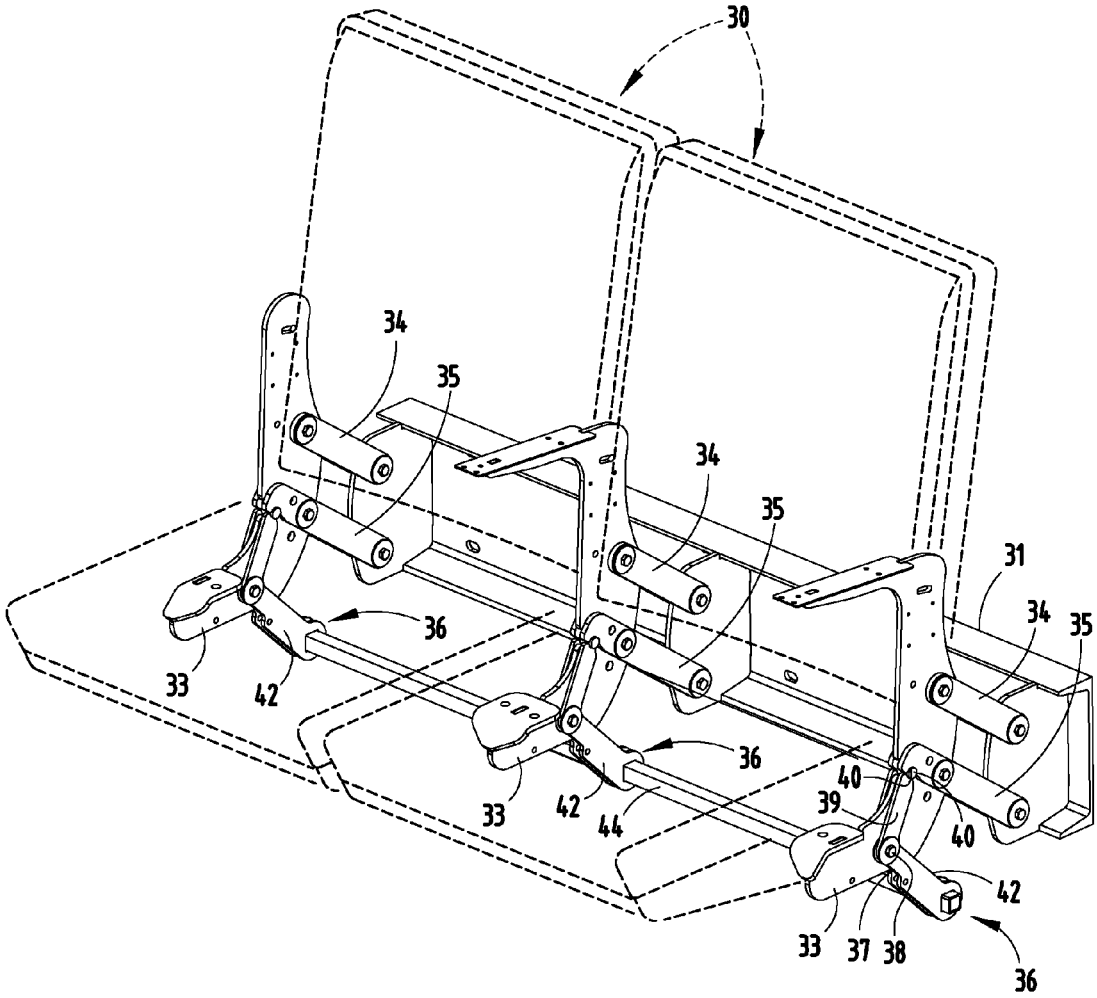
FIG. 9 is a perspective view of FIG. 7.

FIGS. 7-9 illustrate a version of a wall-mounted Varirise™ chair system, and FIG. 10 illustrate an alternate configuration potentially usable on a retractable venue system similar to that shown in FIGS. 1-6. The illustrated system (FIGS. 7-8) is adapted to effectively adjust the height of a row of seats. The amount of height adjustment can be based in part on a desired vertical spacing of seats relative to other seats, thus better matching the needs of the venue/seated-persons. Further, it can do this in a venue or stadium setting. This seating system provides a means of having multiple seat-to-floor tread height options for a single chair without needing to remove or re-mount the seat.

The present seating system (FIGS. 7-9) includes a seat 30 supporting on a wall or building structure. Specifically, the system includes a wall-mounted beam 31 attached to a wall 32, and a seat-frame structure 33 attached to the beam 31 by two links 34 and 35 forming a four bar linkage. A latch mechanism 36 includes an angled locking bracket 37 pivoted to the seat-frame structure 33 by a pivot 38, a first leg 39 with end 40 for engaging a notch 41 in the link 35 to hold the seat 30 in a raised position. An opposing leg 42 provides a handle (e.g. bar 44) for an operator to rotate the locking bracket 37 to a release position, letting the seat 30 move to a lowered position. The various legs 42 can be connected by a transverse handle bar 44 (FIG. 9). Notably, the illustrated links 34 and 35 are pivoted at each end so that the seat 30 moves upward and forward when in the raised position, and moves downward and rearward when in the lowered position. It is contemplated that by changing a length of the links 34 and 35, and/or changing a location of the pivot points at each end, the movement of the seat 30 can be changed to a desired path and to desired end locations (i.e. higher or lower change in height, greater or lesser change in fore-aft movement, changed of angle of support).

FIG. 10 is similar to FIG. 7, but the beam 31 is attached to the nose beam 16 (preferably on top thereof). Alternatively, it is contemplated that the beam 31 could be integrated into and/or formed as part of the beam 16 . . . and the links 34, 35 attached to bracket(s) on the beam 16.

By the arrangement of FIGS. 7-9, seats do not have to be transferred from platform-to-platform, and also loose seating (folding chairs) is avoided (which typically have a lower quality seat comfort). Also, a more subtle problem is avoided, in that very rarely will height restrictions (on movement and storage of seating) allow for the fixed floor mount chairs to remain in-place on the top row, and if they exist, they are typically not integrated and/or are inefficient to assemble, use and/or store.

Typical applications are present at the ends of an arena where usually larger venues have two different sightline configurations for hockey rinks and basketball arrangements (the basketball court is much shorter than a hockey rink, and so the venues put more chairs further out which necessarily causes the rise to shrink (more rows in the same vertical height constraint) and sometimes the top row is not at the same level between the two arrangements. This would also be feasible to use on the side banks should the venue be converted for say a concert arrangement where the end basketball banks are used on the sides for a more cozy "concert in the round" or a boxing type event where the field of use is much smaller.

The current embodiment mounts to a fixed bowl/building wall (or façade) and uses a 4-bar linkage to position the seat in a primarily upper and lower position. It is contemplated that the link 35 could have multiple notches 41 for multiple height positions (i.e. more than two height positions) if desired.

Note since the chairs are attached to the façade, they can remain in-place regardless of the event, much like the fixed chairs in the bowl seating. This eliminates the storage dilemma and saves time and money installing/removing chairs during a conversion.

It is contemplated that other means can be used to adjustably support seats, such as using a manual seat track type arrangement to lock the seats in varying vertical heights, or using manually-engaged locking pins and additional pivoting arrangements other than the illustrated preferred 4-bar linkage design.

It is contemplated that a counterbalance spring or gas shock or other lift-assist device can be added to help minimize the effort required to raise the chairs between different height positions . . . and also can be provided to slow down the adjustment/deployment of seats to the lower position.

It is contemplated that the system can be configured to change the spacing of the chair from the wall in also forward and rearward positions (and not just upper/lower). If this is done, the back pitch (recline angle) of the chair can also be adjusted if desired. For example, this can be done by changing a length of one or both of the links 34 and 35. For example, one reason to change the spacing of seats from the wall might be to allow space for scorers' tables on a wider top row in a basketball configuration. This can be done by adjusting the arc of the 4-bar linkage, orientation of the track system, or similar means.

Chairs can automatically lock in each position and/or have a means to manually (mechanically, electromechanically or otherwise) lock them in position to prevent unauthorized or unintended movement/adjustment.

It is contemplated that a variation could be constructed having an automatic (powered) system, such as by connecting a motor to one or both of the links 34 and/or 35 or drive mechanism coupled to the links Powering mechanisms are known in the art of telescopic platforms and other applications, such a detailed description is not believed to be necessary for an understanding by persons skilled in this art.

It is to be understood that variations and modifications can be made on the aforementioned structures without departing from the concepts of the present invention, and further it is to be understood that such concepts are intended to be covered by the claims unless these claims by their language expressly state otherwise.

We claim:

1. A flexible venue system comprising:

a telescopic platform system including multiple usable tiers movable to an extended configuration, a retracted configuration, and at least one partially retracted configuration, the tiers each including an associated nose beam on a front edge thereof;

a plurality of seats on the tiers with backs movable to a use position when the platform system is extended and movable to a storage position for dense storage when the tiers of the platform system are retracted; and each back being pivotally supported by an associated seating standard of an associated one of the tiers and having a program support bearing mounted along the front edge of the associated one tier that engages a bottom surface of the nose beam that is immediately above the seating standard when the backs are pivoted to the storage position and when the telescopic platform system is in the partially retracted configuration, with a load of the front edge of a first usable one of the tiers being transmitted vertically downwardly along the front edges of all tiers underlying the first usable one tier.

2. The flexible venue system of claim 1, wherein the bearing includes a roller.

3. The flexible venue system of claim 1, wherein the backs are pivotally supported by the associated seating standard for rearward movement when being moved toward the storage position.

4. A flexible venue system comprising:

a telescopic platform system including multiple usable tiers movable to an extended configuration, a retracted configuration, and at least one partially retracted configuration, the tiers each including an associated nose beam on a front thereof;

a plurality of seats on the tiers with backs and seat components movable to a use position when the platform system is extended and movable to a storage position for dense storage when the tiers of the platform system are retracted; and a seating support system supporting the seats, the seating support system for each associated seat including an associated seating standard pivoted to an associated one of the tiers for supporting associated backs with the seating standards each having a program support roller that engages a bottom surface of the nose beam on the nose beam immediately above the seating standard when the seats are in the storage position and when the telescopic platform system is in the partially retracted configuration for supporting and thus managing a load of a first usable one of the tiers.

5. The flexible venue system defined in claim 4, wherein the seats are each front-mounted to associated ones of the tiers.

6. The flexible venue system defined in claim 5, wherein the tiers include a wheeled substructure for rolling support on a floor surface.

7. The flexible venue system defined in claim 4, wherein the tiers include a wheeled substructure for rolling support on a floor surface.

8. A method of providing a flexible venue system comprising steps of:

providing a telescopic platform system including multiple usable tiers movable to an extended configuration, a retracted configuration, and at least one partially retracted configuration, the tiers each including an associated nose beam on a front thereof;

providing a plurality of front-mounted seats on the tiers with backs and seat components movable to a use position when the platform system is extended and movable to a storage position for dense storage when the tiers of the platform system are retracted;

providing a seating support system supporting the seats, the seating support system for each associated seat including an associated seating standard pivoted to an associated one of the tiers for supporting associated backs with the seating standards each having a program support roller positioned to engage a bottom surface of the nose beam on the nose beam immediately above the seating standard; and engaging the program support roller with the bottom surface of the nose beam immediately above the seating standard when the seats are moved into the storage position and when the telescopic platform system is in the partially retracted configuration for supporting and thus managing a load of a first usable one of the tiers.

* * * * *